US005979058A

United States Patent [19]

Henke

[11] Patent Number: 5,979,058

[45] Date of Patent: Nov. 9, 1999

[54] CONTRACTOR HAND TOOL

[75] Inventor: David R. Henke, Maple Grove, Minn.

[73] Assignee: Warner Manufacturing Company, Minneapolis, Minn.

[21] Appl. No.: 09/095,445

[22] Filed: Jun. 10, 1998

[51] Int. Cl.[6] ..... B26B 9/02; B26B 1/02

[52] U.S. Cl. ..... 30/143; 30/144; 30/155; 30/169; 30/353; 7/105

[58] Field of Search ..... 30/155, 158, 160, 30/161, 169, 172, 136, 143, 144, 353, 355, 357; 7/105, 118, 158, 165; 15/105

[56] References Cited

U.S. PATENT DOCUMENTS

| | | | |
|---|---|---|---|
| D. 28,738 | 5/1898 | Hamlis | D8/81 |
| 180,187 | 7/1876 | Bartlett | 7/105 |
| 508,273 | 11/1893 | Brauch | 30/169 |
| 777,411 | 12/1904 | Hall | 7/105 |
| 825,063 | 7/1906 | Lawbaugh | 7/105 |
| 832,455 | 10/1906 | Christensen | 7/105 |
| 960,624 | 6/1910 | Compton | 7/105 |
| 1,015,026 | 1/1912 | Jackson et al. | 7/168 |
| 1,194,044 | 8/1916 | Loomis | 30/353 |
| 1,787,057 | 12/1930 | Ward | 30/144 |
| 2,092,586 | 9/1937 | Naumovich | 7/105 |
| 2,213,071 | 8/1940 | Keller | 30/169 |
| 2,234,242 | 3/1941 | Gilbert | 30/144 |
| 2,839,110 | 6/1958 | Carpenter | 7/105 |
| 3,774,252 | 11/1973 | Cantales | 7/105 |
| 3,789,450 | 2/1974 | Mozdenski et al. | 7/105 |
| 4,095,337 | 6/1978 | Pharr | 30/158 |
| 4,271,592 | 6/1981 | Höptner | 30/157 |
| 4,805,303 | 2/1989 | Gibbs | 30/161 |
| 4,819,289 | 4/1989 | Gibbs | 7/118 |
| 4,890,387 | 1/1990 | Canino | 30/162 |
| 5,009,008 | 4/1991 | Yablonovitch | 30/158 |
| 5,044,079 | 9/1991 | Gibbs | 30/160 |
| 5,063,627 | 11/1991 | Marra | 30/169 |
| 5,095,624 | 3/1992 | Ennis | 30/161 |
| 5,251,352 | 10/1993 | Cullison | 30/169 |
| 5,442,529 | 8/1995 | Hoover | 7/118 |
| 5,495,673 | 3/1996 | Gardiner et al. | 30/155 |
| 5,502,895 | 4/1996 | Lemaire | 30/158 |
| 5,537,750 | 7/1996 | Seber et al. | 30/160 |
| 5,546,625 | 8/1996 | Mealey, Sr. | 30/357 |
| 5,692,308 | 12/1997 | Di Libero | 30/353 |

OTHER PUBLICATIONS

Tom Baldwin, Sketch of an idea submitted to the Assignee Jul. 15, 1994.

*Primary Examiner*—Hwei-Siu Payer
*Attorney, Agent, or Firm*—Merchant & Gould P.C.

[57] ABSTRACT

An easy to hold, safe, single hand operated, foldable, multi-purpose tool, particularly for use during painting for performing a variety of tasks, such as scraping, spreading, cleaning, cutting, sawing and the like, encountered during painting operations. The tool includes an elongate handle having a longitudinal axis, top and bottom longitudinal edges, and first and second opposite ends. A blade is secured to the first end of the handle, with the blade including first and second longitudinal edges and a distal edge extending between the first and second longitudinal edges. The first longitudinal edge of the blade is composed of a plurality of first linear edge sections, with one of the first linear edge sections extending along an axis that does not intersect the handle or any portion of the blade and which extends below the bottom longitudinal edge of the handle at an acute angle relative to the longitudinal axis. The design of the blade prevents scraping of a user's knuckles while gripping the handle and using the tool.

19 Claims, 1 Drawing Sheet

CONTRACTOR HAND TOOL

FIELD OF THE INVENTION

The present invention relates to a tool, in particular a multi-purpose, folding painter's tool.

BACKGROUND OF THE INVENTION

A wide variety of tools have been developed in the past for use during painting operations to perform such tasks as scraping, spreading, cutting, opening paint cans, and the like. Generally, these tools are designed such that a tool is able to perform a single task, or they are designed such that a tool performs multiple tasks. In many instances, a multi-task tool is preferred since it reduces the number of tools which need to be used, thus reducing cost to the user and making the painting operation easier.

One problem with these conventional tools, whether single task or multiple task, is that they are rather large and bulky, making them difficult, if not impossible, to be conveniently carried by the user so as to be ready for use if the need arises, and making them difficult to store when not in use. Further, many of these tools have blade portions with sharp edges and points, making them dangerous to both the user and others, particularly while ascending and descending ladders, scaffolding, and the like. Often times with tools of this sort, a separate carrying pouch or sheath, usually made of leather, is utilized to carry or encase the blade portion of the tool, with the pouch being worn by the user by being secured to the users belt, in order to protect the user from the blade portion. However, the pouch is an added expense in addition to the expense of the tool, and often times gets in the way of the user.

Tools, such as the well known folding knife, have been developed where a blade portion of the tool folds into a handle portion of the tool such that the overall size of the tool is reduced, making it easier and safer to carry. The blade portion is simply pivoted into and out of the handle by the user. However this generally requires the use of both hands by a user. Often times, the user only has one hand free, making the use of these folding knife tools difficult, if not impossible.

U.S. Pat. No. 4,095,337 and 5,009,008 have attempted a solution to this problem by attaching an actuator to the blade portion to allow one handed operation of the knives. The user simply attaches the actuator to the blade, permitting the user to open and close the knife by using a finger to push or pull against the actuator. However, these actuators are after market add-ons to the knives, such that the handle of the knives are not designed to accommodate the actuators when the knives are folded whereby the actuators prevent the blade from folding completely into the handle and/or project awkwardly from the handle, detracting from the appearance of the knife and possibly snagging on the user's clothing. Further, since the actuators are attached by the user to the blade, the actuators may at times become loose and fall off of the blade, whereby they may be lost, or at the least rendering one handed operation of the knife impossible.

What has been needed then is a painter's tool having a multi-purpose locking blade, which can fold into a handle thus making it safer while ascending and descending ladders, scaffolding, and the like, and which is specifically designed for one-handed operation. Since the blade folds into the handle, the blade should be substantially disposed within the handle when folded, while at the same time minimizing the handle size, so that dangerous blade portions are not exposed and the size of the tool is kept to a minimum.

SUMMARY OF THE INVENTION

Therefore the general purpose of the present invention is to provide an easy to hold, safe, single hand operated, foldable, multi-purpose tool, particularly for use during painting for performing a variety of tasks, such as scraping, spreading, cleaning, cutting, sawing and the like, encountered during painting operations.

A preferred embodiment of the tool in accordance with the principles of the invention includes an elongate handle having a longitudinal axis, top and bottom longitudinal edges, and first and second opposite ends. A blade is secured to the first end of the handle, with the blade including first and second longitudinal edges and a distal edge extending between the first and second longitudinal edges. The first longitudinal edge of the blade is composed of a plurality of first linear edge sections, with one of the first linear edge sections extending along an axis that does not intersect the handle or any portion of the blade and which extends below the bottom longitudinal edge of the handle at an acute angle relative to the longitudinal axis.

In another preferred embodiment of the tool in accordance with the invention, the tool includes an elongate handle extending along a longitudinal axis. The handle has first and second side walls, top and bottom longitudinal edges, first and second opposite ends, and a channel formed between the side walls and extending through the bottom longitudinal edge. A dog-leg shaped blade is pivotally secured to the first end of the handle whereby the blade is pivotable between a folded position within the channel and an extended position outside of the channel. The dog-leg shaped blade includes a first longitudinal edge, a second longitudinal edge and a distal edge extending between the first and second longitudinal edges. Each of the first and second longitudinal edges includes a base edge section, a tip edge section distant from the base section, and an intermediate edge section interconnecting the base section and tip section. The intermediate edge sections are angled such that the juncture of each intermediate section and each tip edge section is disposed at a level below the respective base edge section.

One advantage of the tool is that the blade is specifically shaped to prevent scraping of a user's knuckles while gripping the handle and using the tool. This is due to the fact that the tip edge section of the first, or lower, longitudinal edge of the blade is disposed below the bottom longitudinal edge of the handle, so that the user's fingers are spaced further from the work surface while utilizing the tip edge section of the tool to perform tasks on the work surface.

In a further embodiment of the invention, an acute corner is formed between the distal edge of the blade and the one linear edge section, which is disposed adjacent the tip of the blade. Since the corner of the tool is less than ninety degrees, it can fit more easily into cracks and comers of work surfaces, thereby facilitating cleaning of the cracks and corners.

In yet another embodiment of the invention, the blade is designed with two different sharpened edges as well as a saw-tooth edge, thereby increasing the number of potential uses for the tool. Further, the blade preferably tapers in thickness toward the distal end thereof, thereby providing flexibility to the blade.

These and various other advantages and features of novelty which characterize the invention are pointed out with particularity in the claims annexed hereto and forming a part hereof. However, for a better understanding of the invention, its advantages and objects obtained by its use, reference should be made to the drawings which form a further part hereof, and to the accompanying description, in which there is described a preferred embodiment of the invention.

DETAILED DESCRIPTION OF THE PREFERRED EMBODIMENT

Figure 2:
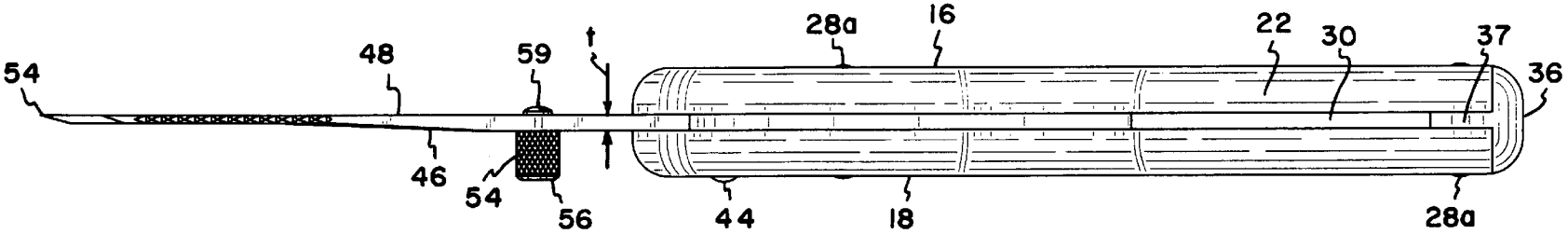
FIG. 2 is a top plan view of the tool shown in FIG. 1.

Referring now to the figures, there is illustrated a preferred embodiment of the painter's tool in accordance with the principles of the present insention, the tool being designated by the reference number 10. The tool 10 includes a handle 12 and a blade 14 secured to the handle portion.

The handle 12 is generally elongate with a longitudinal axis A-A', and is formed from a suitable rigid, metallic, wood or plastic material. A preferred plastic material is a lightweight nylon plastic so as to make the tool 10 light in weight. The handle includes first and second side walls 16, 18 which define bottom and top longitudinal edges 20, 22 and generally first and second ends 24, 26. The exterior portions of the side walls 16, 18 are generally identical to each other so as to make formation of the side walls easier. The side walls 16, 18 are rigidly connected together by fasteners 28*a,b* to form a longitudinal channel 30 therebetween. The channel 30 extends between the edges 20, 22 and from the first end 24 to the second end 26. The side walls 16, 18 can include surface roughening, such as knurling 32, in order to increase a user's grip on the handle and prevent slipping.

A hammer cap 36, preferably made of metal, is secured to the second end 26. As can be seen in FIG. 2, the hammer cap includes a rib 37 extending therefrom and which is disposed within the channel 30 between the side walls 16, 18, for spacing the side walls apart at the end 26. The fasteners 28*a* extend between the side walls and through the rib 37, thus securing the hammer cap in place and securing the side walls together at the second end. The hammer cap 36 allows the tool 10 to be used for pounding in nails and the like.

Figure 1:
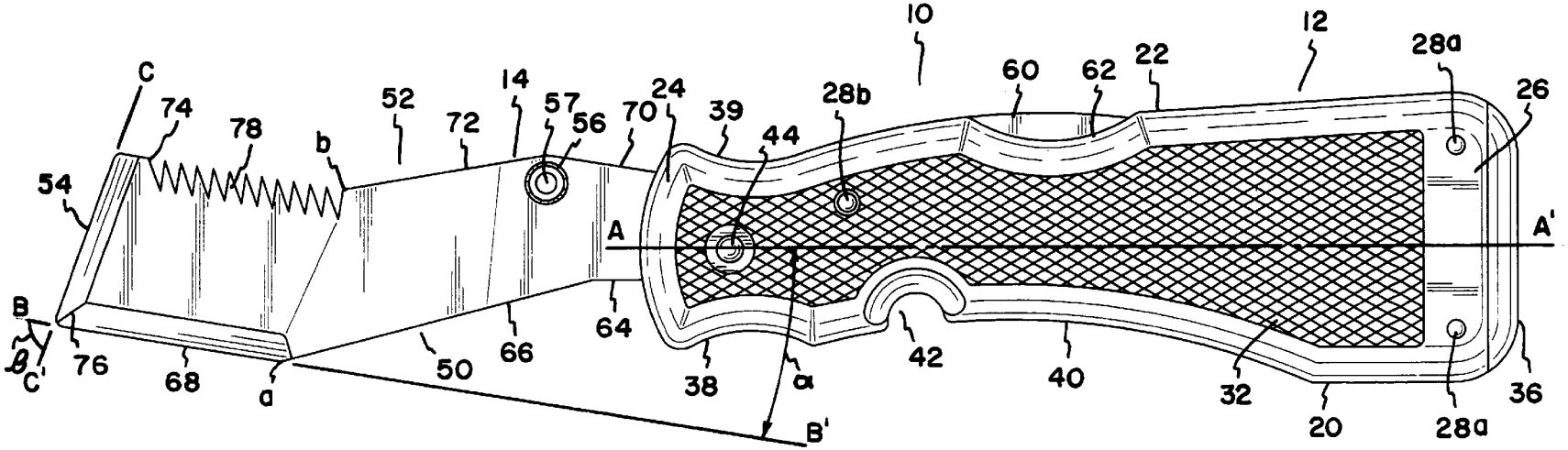
FIG. 1 is a side view of the tool according to the present invention, with the blade in the extended position.

As part of the ergonomic design of the handle, and as can be seen in FIG. 1, the handle is generally tapered from the second end to the first end. Further, the bottom handle edge 20 includes a curvilinear, preferably concave, finger rest portion 38, and an arcuate, preferably concave, gripping portion 40 extending from the concave portion 38 towards the second end 26. A round notch 42 is formed in the side wall 18 within the concave gripping portion 40, and a round notch (not shown) is also formed in the side wall 16 at a location corresponding to the notch 42. The purpose of the notches will become latter apparent, however the notch 42 is provided to accommodate a right handed user of the tool 10, while the notch in the side wall 16 is provided to accommodate a left handed user of the tool 10. The notches could have configurations other than round, such as rectangular or triangular. Further, the top edge 22 includes a curvilinear, preferably concave, finger or thumb rest portion 39 adjacent the end 24, and aligned with the rest portion 38.

The blade 14 is also elongated, and is made of a metallic material. The blade is connected at one end thereof between the side walls 16,18 of the handle 12 by a pivot pin 44 so as to permit the blade to pivot between an extended position, shown in FIGS. 1 and 2, and a folded position wherein the blade is disposed within the channel 30. The blade 14 includes first and second side surfaces 46, 48, first and second longitudinal edges 50, 52, and a distal edge 54 at a second end of the blade extending between and interconnecting the longitudinal edges 50, 52.

As shown, the first side surface 46 includes a round finger actuation knob 56 detachably connected thereto adjacent the second edge 52, in order to accommodate a right handed user. The knob 56 is disposed on the surface 46 such that when the blade is in the folded position, the knob will be disposed within the notch 42 in the side wall 18. Alternatively, the knob can be removed from the side surface 46 and connected to the second side surface 48 in order to accommodate a left handed user, such that when the blade is in the folded position, the knob will be disposed within the notch in the side wall 16.

The knob 56 includes a central, threaded bore 57 extending therethrough which receives a headed, externally threaded screw extending through a suitably located hole in the blade. The screw is extended through the hole in the blade and the knob is screwed onto the screw in order to detachably secure the knob to the blade. The screw includes a head 59 adjacent the side of the blade which is opposite the knob, with the head including any conventional socket, such as a hexagonal socket for receiving an Allen wrench or a socket for receiving a screw driver, in order to permit actuation of the screw for detachable securement of the knob to either side of the blade. depending upon which side of the blade the threaded screw projects from. The outer surface of the knob is preferably roughened, such as by knurling 58, to prevent slipping of the user's finger thereon. It should be realized that although the knob 56 is shown as being round, other knob shapes, such as rectangular or square, can be used without changing the scope of the invention. However, the shape of the knob will generally correspond with the shape of the notches in the handle side walls 16, 18 to assure proper fit of the knob within the respective notch. Further, although the knob is described as extending from either side of the blade, a knob could be provided which extends from both sides of the blade, in which case the knob would simultaneously accommodate both left and right handed users without requiring the knob to be moved from one side of the blade to the other. In this instance, the notches would receive both of the knob portions extending from the sides of the blade, when the blade is folded.

The blade 14 is held in the extended position by a conventional, selectively disengageable locking mechanism which securely holds the blade in this position. A conventional lock release lever 60 is suitably engaged with the locking mechanism such that when the lever 60 is pivoted or pressed downward, the locking mechanism is released, and the blade can be pivoted to the folded position. The fastener 28b acts as a pivot point for the lever 60, with the lever 60 being disposed in the channel 30 between the side walls 16, 18, thus forming a spacer for the side walls. Locking and lock release mechanisms of this type are generally well known in the art, and thus not further described herein. Reference is made to U.S. Pat. No. 4,805,303 and 5,044,079, each of which show examples of suitable locking and lock release mechanisms that are useable with the invention. As shown in FIG. 1, the top edge 22 is provided with a concave depression 62 between the two ends 24,26 in order to facilitate pressing of the release lever 60.

As shown in FIG. 1, the longitudinal edge 50 of the blade 14 is composed of a plurality of adjacent linear edge sections, including a linear base edge section 64, a linear intermediate edge section 66 and a linear tip edge section 68. Similarly, the longitudinal edge 52 is composed of a plurality of adjacent linear edge sections, including a linear base edge section 70, a linear intermediate e dge section 72 and a linear tip edge section 74. Thus, the number of linear edge sections of the edge 50 equals the number of linear edge sections of the edge 52.

Each of the base edge sections 64, 70 extend from the first end 24 of the handle 12 when the blade is extended. The intermediate edge sections 66, 72 interconnect the respective base edge sections 64, 70 and tip edge sections 68, 74, and are angled downwardly from the base edge sections. The tip edge sections 68, 74 angle upwardly from the intermediate edge sections 66, 72 and adjoin with the distal edge 54. As evident from FIG. 1, the intermediate sections 66, 72 are angled downwardly a sufficient amount so that the junctures a,b of the intermediate edge sections 66, 72 and the tip edge sections 68, 74 are disposed at a level below the respective base edge sections 64, 70. Such a construction gives the blade a dog-leg shape.

Further, it is seen that since the tip edge section 68 is angled upward from the juncture a with the intermediate section 66, the axis B-B' along which the tip edge section 68 extends does not intersect any portion of the handle 12 and extends below the bottom edge 20 of the handle at an angle a relative to the longitudinal axis A-A' of the handle. The angle $\alpha$ is an acute angle, i.e. less than 90 degrees, and, as an example, the angle $\alpha$ could be about 45 degrees. Thus the tip edge section 68 is disposed generally below the bottom edge 20 of the handle 12.

Due to the dog-leg shape of the blade 14 and the fact that the tip edge section 68 is disposed below the bottom edge of the handle 12, the user's fingers will be spaced further from a work surface while utilizing the tip edge section of the tool to perform tasks on the work surface, thereby reducing the likelihood of the user's finger contacting the work surface during use and thus reducing scrapes on the user's fingers.

The tip edge section 68 adjoins the distal edge 54 and forms a corner 76 therewith. The distal edge 54 is angled backward toward the handle 12 such that the axis C-C' of the distal edge 54 is not perpendicular to the axis B-B'. Instead, the axis C-C' is disposed at an acute angle $\beta$ to the axis B-B', so that the comer 76 is an acutc corner. By angling the distal edge 54 backward in this manner, the corner 76 can fit more easily into cracks and comers of work surfaces, thereby facilitating cleaning of the cracks and corners.

The tip edge section 68 and the distal edge 54 are sharpened by beveling the side surface 46 adjacent the section 68 and edge 54 along the entire lengths thereof. Of course, it should be realized that the side surface 48 could be beveled instead, without changing the scope of the invention. Thus, the blade can be used generally as a scraper, spreader, and as a utility knife. Further, the tip edge section 74 includes saw-teeth 78 from the juncture b and extending adjacent to the distal edge 54. The saw-teeth 78 on the tip edge section 74 can be used to saw, rasp and cut, thereby expanding the range of uses of the tool 10.

As shown in FIG. 2, the blade 14 is also tapered between the end thereof connected to the handle 12 and the distal edge 54, thereby providing flexibility to the blade. In particular, it can be seen that the thickness t of the blade 14 is generally constant along the base edge section 64,70 from the handle to a point past the actuation knob 56 within the intermediate edge section 66,72 where the thickness starts decreasing. The blade thickness then decreases along the intermediate edge sections 66,72 and continues decreasing to the distal edge 54.

Optionally, further members could be pivotally attached to the tool to augment the operation of the blade 14. These members include a screwdriver, a flexible putty blade, a knife blade, an electricians screwdriver blade, and/or a screwdriver can closer blade. These members would be pivotally attached to the handle and be able to fold into the channel, along with the blade 14. Further, a belt clip could be attached to the handle to permit attachment of the tool to the user's belt.

In use, with the blade in its folded position and the knob attached to the side surface 46, the user can simply hold the tool in one hand, and using the same hand, use a thumb or finger to push against the knob 56, aided by the notch 42, so as to pivot the blade to the extended position where it is locked in place. Once the blade is extended, the ergonomic design of the handle aids in using the tool. The finger rest portions 38,39 allow the user to apply increased pressure with thumb and finger during difficult scraping or cutting operations. The concave portion 40 permits easy grasping of the tool in the user's hand. Further, the multi-purpose design of the blade 14 allows the tool 10 to perform many operations, such as scraping, spreading, scoring, sawing, scoring, trimming, crack cleaning, rasping, cutting, and pounding. When the blade is not being used, the user simply pushes the release lever 60 to unlock the locking mechanism, and using a thumb or finger to push the knob, the blade is pivoted to the folded position, with the knob disposed within the notch 42.

For a left handed user, the knob is detached from the surface 46 and reattached to the blade on the surface 48. The notch within the side wall 16 will then receive the knob when the blade is folded and aid the left handed user in actuating the knob.

It is to be understood that while certain embodiments of the present invention have been illustrated and described, the invention is not limited to the specific forms or arrangements of parts described and shown.

I claim:

1. A tool comprising:

an elongate handle extending along a longitudinal axis, said handle having first and second side walls, top and bottom longitudinal edges, first and second opposite ends, and a channel formed between said side walls and extending through said bottom longitudinal edge;

a dog-leg shaped blade pivotally secured to said first end of said handle whereby said blade is pivotable between a folded position within the channel and an extended position outside of the channel; and the dog-leg shaped blade includes a first longitudinal edge, a second longitudinal edge and a distal edge extending between said first and second longitudinal edges; each of said first and second longitudinal edges includes a base edge section, a tip edge section distant from said base edge section, and an intermediate edge section interconnecting the base edge section and the tip edge section, and said intermediate edge sections are angled such that a juncture of each said intermediate section and each said tip edge section is disposed at a level below the respective said base edge section.

2. The tool according to claim 1, wherein said distal edge and the tip edge section of said first longitudinal edge are sharpened, and the tip edge section of said second longitudinal edge includes saw teeth.

3. The tool according to claim 1, wherein said tip edge section of said first longitudinal edge and said distal edge are adjoining and form an acute corner.

4. The tool according to claim 4, wherein the blade has a thickness in plan which is tapered from the intermediate edge sections to the distal edge.

5. A tool comprising:

an elongate handle having a longitudinal axis, top and bottom longitudinal edges, and first and second opposite ends;

a blade secured to said first end of said handle, the blade including first and second longitudinal edges and a distal edge extending between said first and second longitudinal edges;

said first longitudinal edge composed of a plurality of first linear edge sections, one of said first linear edge sections extending along an axis that does not intersect the handle or any portion of the blade and which extends below the bottom longitudinal edge of said handle at an acute angle relative to the longitudinal axis; and wherein said handle further includes first and second side walls, and a channel defined between said side walls and extending through said bottom longitudinal edge; and said blade is pivotally secured to said handle whereby said blade is pivotable between a folded position within the channel and an extended position outside of the channel.

6. The tool according to claim 5, further including an actuation knob secured to said blade for facilitating actuation of the blade between the folded and extended positions.

7. The tool according to claim 6, wherein at least one of said side walls includes a notch formed therein, and said actuation knob is disposed within said notch when said blade is in the folded position.

8. The tool according to claim 5, wherein said second longitudinal edge is composed of a plurality of second linear edge sections, one of said second linear edge sections being formed with saw teeth.

9. The tool according to claim 8, wherein said saw toothed, linear edge section is located adjacent a tip of the blade distant from the handle, and said saw toothed, linear edge section is joined with said distal edge.

10. The tool according to claim 8, wherein the number of said first linear edge sections equals the number of said second linear edge sections.

11. The tool according to claim 10, wherein each of said first linear edge sections and said second linear edge sections includes a base edge section, a tip edge section distant from said base edge section, and an intermediate edge section interconnecting the base edge section and the tip edge section.

12. The tool according to claim 11, wherein said intermediate edge sections are angled such that a juncture of each said intermediate section and each said tip edge section is disposed at a level below the respective said base edge section.

13. The tool according to claim 11, wherein the blade has a thickness in plan which is tapered.

14. The tool according to claim 13, wherein the thickness of the blade is substantially constant along said base edge sections, and the thickness of the blade starts decreasing along the intermediate edge sections.

15. The tool according to claim 13, wherein the thickness of the blade decreases from the intermediate edge sections to the distal edge.

16. A tool comprising:

an elongate handle having a longitudinal axis, top and bottom longitudinal edges, and first and second opposite ends;

a blade secured to said first end of said handle, the blade including first and second longitudinal edges and a distal edge extending between said first and second longitudinal edges; and said first longitudinal edge composed of a plurality of first linear edge sections, one of said first linear edge sections extending along an axis that does not intersect the handle or any portion of the blade and which extends below the bottom longitudinal edge of said handle at an acute angle relative to the longitudinal axis, and wherein said one linear edge section is located adjacent a tip of the blade distant from the handle, and said one, first linear edge section is adjacent said distal edge and forms a corner therewith.

17. The tool according to claim 16, wherein the distal edge is not perpendicular to said one linear edge section.

18. The tool according to claim 17, wherein the distal edge is disposed at an acute angle relative to said one linear edge section.

19. The tool according to claim 16, wherein said distal edge and said one linear edge section are sharpened.

* * * * *